United States Patent [19]

Takino et al.

[11] 4,428,729

[45] Jan. 31, 1984

[54] DISCHARGE TYPE IGNITOR FOR OIL STOVE

[75] Inventors: Kenichi Takino, Yao; Kenji Murakami, Takaishi, both of Japan

[73] Assignee: Sharp Kabushiki Kaisha, Osaka, Japan

[21] Appl. No.: 247,559

[22] Filed: Mar. 25, 1981

[51] Int. Cl.[3] ..... F23Q 7/08

[52] U.S. Cl. ..... 431/262; 431/298; 431/315

[58] Field of Search ..... 431/261, 262, 300, 301, 431/282, 298, 315

[56] References Cited

U.S. PATENT DOCUMENTS 1,610,131 12/1926 Grabner ..... 431/261
3,134,423 5/1964 Smith ..... 431/261 X

FOREIGN PATENT DOCUMENTS 56-46928 4/1981 Japan ..... 431/298
1489973 10/1977 United Kingdom ..... 431/261

*Primary Examiner*—Edward G. Favors
*Attorney, Agent, or Firm*—Birch, Stewart, Kolasch & Birch

[57] ABSTRACT

There is provided an ignitor assembly for oil stoves of the type wherein an exposed portion of a wick is fired to burn oil. The ignitor assembly includes an ignitor plug held in alignment with the exposed portion of the wick for firing the wick through the utilization of discharge originated from the ignitor plug.

6 Claims, 8 Drawing Figures

DISCHARGE TYPE IGNITOR FOR OIL STOVE

BACKGROUND OF THE INVENTION

This invention relates to an ignitor for movable wick type of oil stoves, and more particularly an improved ignitor utilizing discharge phenomenon for effecting the firing of the wick.

The conventional ignitors for use in oil stoves are such that they may fire the wick from inside an inner flame cylinder by forcing a heater into direct contact with the wick to fire the wick from outside the periphery of the wick by means of the heater. Alternatively, the wick may be fired through an openable ignitor window outside the wick by forcing a heater into direct contact the wick upon actuation of a push button or a knob. Still another way to fire the wick is by use of a pilot wick.

An example of the conventional ignitor assembly is now described in more detail by reference to FIG. 1. A stove base board 1 is seated on the periphery of a wick cylinder 2 and a rotary sheet 3 is held rotable by means of a shaft 4 and an elongated hole 5. The shaft 4 is mounted on the base board side 1 and the elongated hole 5 is mounted on the rotary plate side 3 in the shown example so that the rotary plate 3 is slidable about the pivot A, though it is not limited thereto as to location. An ignitor handle 6 is disposed outside the rotary plate 3 and held so that its end contacts an edge portion of a cylindrical casing 9 constituting a combustion chamber together with an inner shell 7 and an outer shell 8 so as to hoist the combustion chamber during rotation. The remaining end of the rotary plate 3 is provided with a bent portion 11 which abuts on a heater angle 10 held rotable by means of a shaft 24 as a fixed pivot B and rotates the heater angle 10 during rotation. A heater mount 13 is secured on the heater angle 10 for installation of an ignitor heater 12 by cauking or otherwise as well as a movable contact 15 which mates with a stationary contact 14 seated on the base board side 1 to set up an ignitor heater switch. To return the heater angle 10 to its home position upon completion of ignition, a spring 16 is mounted on a shaft 24 with its end secured on the heater angle 10 and the other end secured on part of the base board 1.

There is further provided a wick 17, an inner shell 18, an outer shell 19, lead wires 20 and 21, fixtures 22 and a wick adjust knob 23. The ignitor heater 12 is constructed as shown in FIG. 2, wherein a plug 24 includes a pair of standing electrode rods 26 each having an outwardly oriented tip portion serving as a contact 25 and a heater coil 27 extending between the electrode rods 25 (with a slight space with respect to the wick when the contacts 25 are in contact with the wick of an oil stove). The heater coil 27 is held in parallel with the contacts 25.

The plug 24 has a cover 28 concealing the electrode rods 26 and the heater coil 27 with its tip portion substantially level with the contacts 25. The electrode rods 26 are seated in an insulator 29.

When the ignitor handle 6 on the rotary plate 3 is turned down in the direction of the arrow C, the rotary plate 3 rotates about the pivot A and hoists at its one end the combustion chamber in the direction of the arrow D. At the same time the bent portion 11 slides frictionally on the back of the heater angle 10 rotable about the pivot B and then rotates the heater angle 10 in the direction of the arrow E so that the heater coil 27 comes into contact with the heater coil 27 of the ignitor heater 12. In the course of this movement the movable contact 15 resting on the heater angle 10 is brought into contact with the stationary contact 14 on the base board 1 so that the ignitor heater 12 is energized to fire the wick 17. Upon completion of ignition the heater angle 10 returns to its home position by the action of the spring 16 and the rotary plate 3 also returns to its home position.

Since in the above example the burner assembly is hoised and the heater angle 10 is rotated so as to force the ignitor heater 12 into contact with the wick 17 through mechanical interconnection upon the turning movement of the handle 6, smooth and stable ignition demands strict specifications of these components. For example, an error on the order of millimeters is not permissible in connection with the spacing between the the heater coil 27 and the wick 17. Very skillful machining is necessary for preparation of the components during manufacture of the ignitor assembly. If such machining is not successfully accomplished, faulty components sometimes result. In other words, installation of such an automatic ignitor assembly on oil stoves provides a convenience for the operator but results in complexity of the structure and manufacture of oil stoves. This also requires precise machining tools and machines and inevitably increases the cost.

OBJECTS AND SUMMARY OF THE INVENTION

Accordingly, it is an object of the present invention to provide a new ignitor assembly which takes advantage of discharge phenomenon for effectively firing a wick of an oil stove while avoiding the above discussed problems with the prior art ignitor assembly.

Another object of the present invention is to provide a ignitor assembly which not only exhibits performances (as for firing speed, power consumption, etc) comparable with the conventional firing heater but also offers superior advantages over the conventional devices.

In accordance with a preferred aspect of the present invention, there is provided an ignitor assembly for oil stoves of the type wherein an exposed portion of a wick is fired to burn oil. The ignitor assembly includes an ignitor plug held in alignment with the exposed portion of the wick for firing the wick through the utilization of discharge originated from the ignitor plug.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE INVENTION

Figure 1:
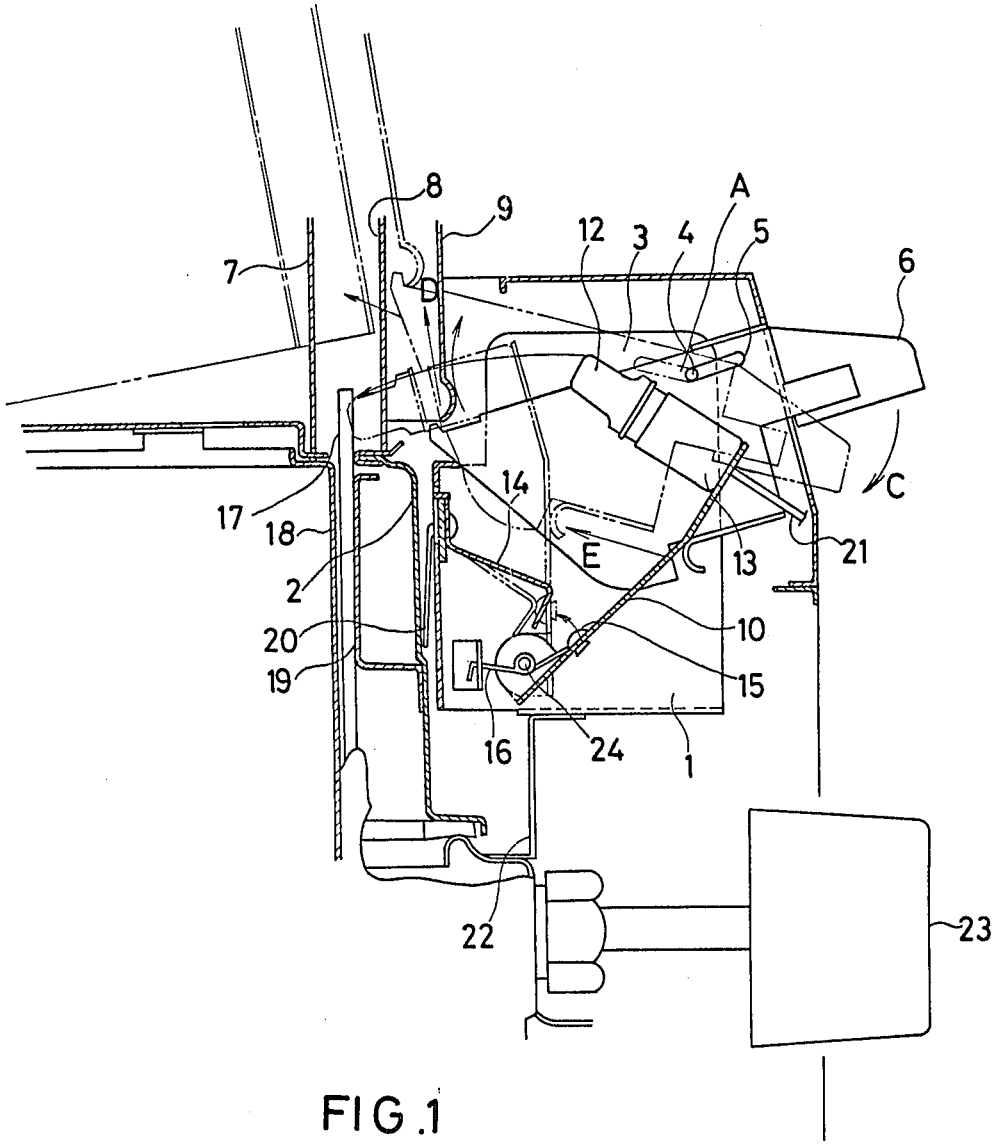
FIG. 1 is a cross-sectional view of an essential part of the conventional ignitor assembly for oil stoves.
Figure 2:
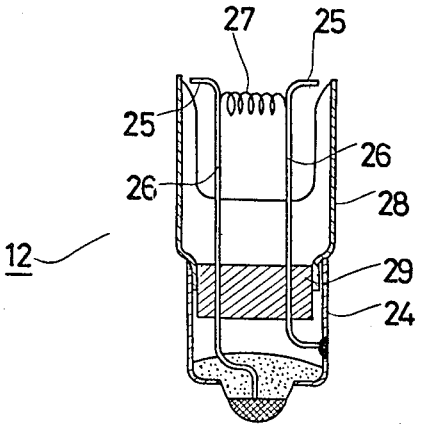
FIG. 2 is a cross-sectional side view of an example of an ignitor plug used in the conventional ignitor assembly.
Figure 3:
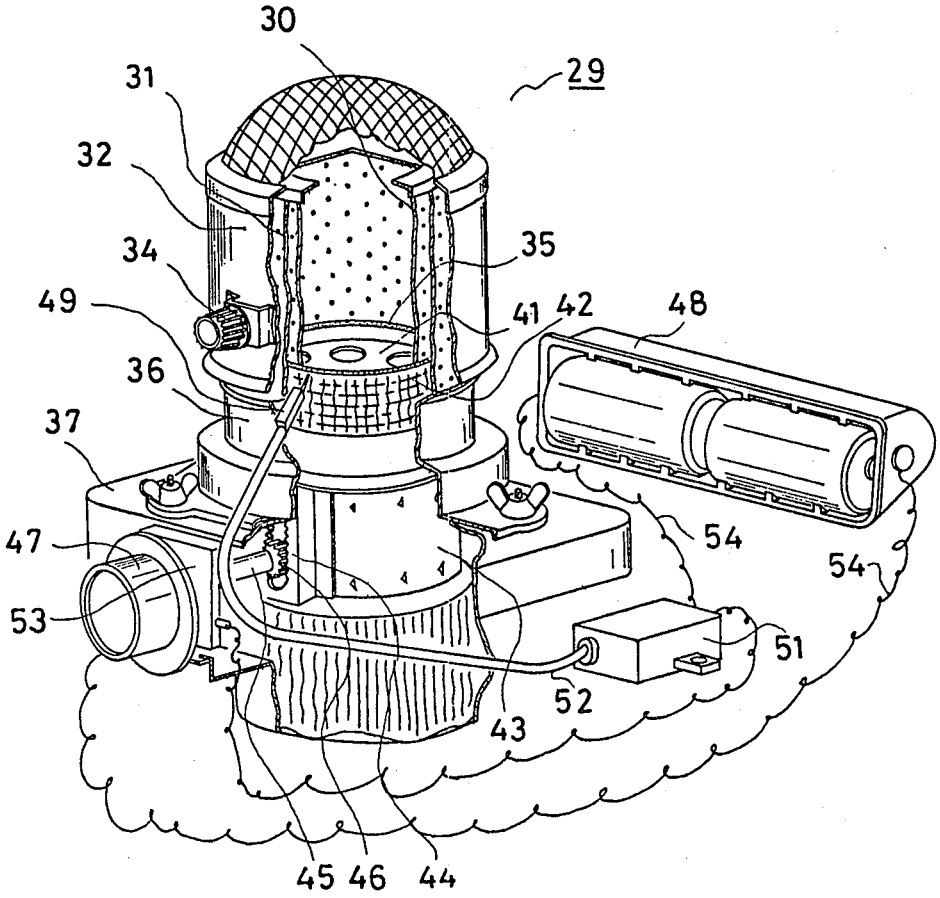
FIG. 3 is a fragmentary perspective view of an embodiment of the present invention.
Figure 4:
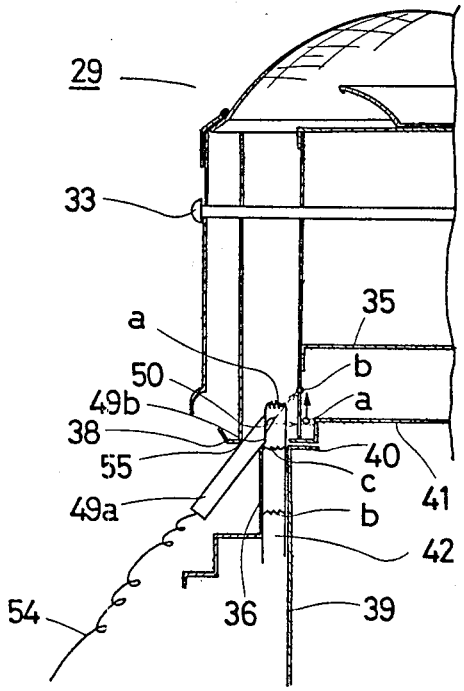
FIG. 4 is a cross-sectional view of an essential part of the embodiment of FIG. 3.

The present invention will now be described in detail by way of a specific embodiment of shown in FIGS. 3 to 6. Referring particularly to FIG. 3, there is shown in a fragmentary exploded perspective view an oil stove with an ignitor assembly according to an embodiment of the present invention. A burner 29 generally includes an inner shell 30, an outer shell 31 and a cylindrical casing 32 all coaxial with a cross pin 33 (see FIG. 4), a burner handle 34, a perforated bottom plate 34, a coiled wire (not shown), etc. An outer wick cylinder 36 is mounted on a fuel container 37 and has its upper end bent at an angle of 90° and constituting a burner-mounting flange 38 as shown in FIG. 4. An inner wick cylinder 39 has its upper end facing inwardly to constitute a burner-mounting flange 40. The periphery of a wick top 41 is seated on the flange 40.

A combustion wick 42 is held movable in a vertical direction within the wick cylinders 39 and 36 with its lowest end being dipped into oil in the oil container 37. It is obvious that the stove is adapted for use with paraffin, kerosene or other liquid fuels (referred to generally as "oil" hereafter). Returning to FIG. 3, a cylindrical wick holder 43 has an elongated rack 44 at a portion of its periphery to enable the wick to move up and down. The rack 44 meshes with a pinion 46 at the tip of a wick adjust shaft 45. Revolution of a wick adjust knob 47 secured at the other end of the shaft 45 causes a raising and lowering of the wick through the wick holder 43. The span of movement of the wick is defined by the highest level a and the lowest level b (extinguish position) as shown in FIG. 4. All that is necessary to move the wick 42 from the level a to the level b is to rotate the knob 47 within a complete revolution (say, about 330°), thus providing the operator's convenience in moving up and down the wick by means of the knob 47. The above mentioned arrangement is not different from the conventional moving wick type oil stove.

The feature of the present invention resides in a new concept of introducing discharge ignition widely used for firing a variety of combustion gases into the field of wick type oil stoves. In addition, the present invention allows implementations of a ignitor assembly which offers superior advantages over the conventional ignitor as well as exhibiting operating performances (for example, firing speed and power consumption).

In the embodiment of the present invention, the ignitor assembly is powered with two serially connected 1.5 V batteries which are housed in a casing 48 at the back of the oil stove as seen from FIG. 3.

As indicated in FIG. 4, a discharge type ignitor plug 49 which plays an important role in the present invention extends from outside the mount 38 of the outer cylinder 36 in between the outer and inner shells 30 and 31.

The discharge type ignitor plug 49 comprises a housing **49*a* constructed of ceramic material of a rectangular configuration each side of 7 mm to 10 mm long and a pointed discharge pin 50 having a overhang extending about 2 mm from the center of an edge surface 49*b* of the housing 49*a***.

In FIG. 3, a high voltage generator 51 is adapted such that it may boost a total of 3 V DC voltage up to about 14 kV for supply to the ignitor plug 49. A cable 52 is routed from the high voltage generator 51 and the ignitor plug 49.

A boxlike microswitch 53 is provided for controlling the generation of a high voltage and thus the power supply. The microswitch 53 is disposed in the neighborhood of the wick adjust knob 47. Lead wires 54 are electrically connected between the power source, the high voltage generator 51 and a switch in the switch box 53. It is preferable that the high voltage generator 51 is in a proper location where it will not be heated to an elevated temperature during combustion of oil nor interfer with the installation of other components, for example, a recess in the back of the oil stobe.

When firing of the wick 42 is desirable, all that is necessary is to move up the wick 42 and initiate discharge toward the inner shell 30 grounded via the discharge pin 50. As a matter of fact, the wick is fired within 3 to 4 sec in the illustrated embodiment. This discharge ignition is, however, not expected to fire the wick so quickly and easily as spark discharge fires gas such as utility gas.

(Installation Of The Ignitor Plug 49)

In order that the ignitor plug 49 neither interfers with installation and removal of the burner 29 and the movement of the wick nor causes a dangerous situation, the ignitor plug 49 is inserted externally from the bottom and is guided obliquely upwardly into a mounting hole 55 formed on the knob side 47 of the mounting flange 38 resting on the outer wick cylinder 36 as seen from FIGS. 3 and 4. Since the mounting hole 55 is formed inside the position of the lowest end of the outer shell 31, it demands no special machining of the burner 29 and has no adverse effect on combustion.

The relative dimensions between the plug 49 and other components will be more clear from a review of FIG. 4. The edge surface **49*b* of the ignitor plug 49 is cut to be substantially flush with the inner face of the outer wick cylinder 36 and held in close proximity to a side of the wick 42 without intefering the movement of the wick 42 while the wick 42 is raised. The discharge pin 50 extends obliquely upwardly from the edge surface 49*b* to the inner shell 30 by about 2 mm with its point about 7–8 mm above the mount 38. The wick 42, on the other hand, is about 4–5 mm thick and extends in the order of 9–10 mm upwardly of the mount 38 from between the inner and outer shells 39 and 36. When the wick 42 is moved up to the level a, the discharge pin 50 plungs into the upper end portion of the wick 42 (for example, about 2 mm). It is noted that the wick 42 contains no wefts in an upper edge portion of about 5 mm from the upper extreme with no possibility that the pin 50 may interfer with the movement of the wick 42**.

The spacing between the pointed tip of the discharge pin 50 and the periphery of the inner cylinder 30 is of the order of 4 mm to 6 mm, where sparks are developed due to discharge. However, no discharge is permitted to take place about the outer wick cylinder 31 because of the outer cylinder side of the outer wick 31 being sealed against the discharge pin 50 via the edge surface **49*b* of the ceramic housing 49*a*. Moreover, discharge heads for the point a of the inner cylinder 30 is the nearest distance from the pin 50 until the upper end of the wick 42 reaches the level c (flush with the mount 38). If the upper end of the wick 42 is in the neighborhood of the pin 50, discharge originating from the pin 50 is deflected from the wick 42 in the direction toward the point b due to a nearby insulator. This makes sure that discharge always travels through the upper end portion of the wick 42**, thus shortening ignition time. Matter-of-factly, discharge phenomenon is affected by various factors and discharge may take place in a manner somewhat different from the above situation.

(High Voltage Generator 51)

This device 51 is generally similar to the conventional high voltage generator except for the following requirements for voltage value, discharge times and consumption current.

With the DC source voltage of 3 V, voltage generated is about 14 KV, discharge times are 170 per second and current consumption is on the order of 690 mA. With the DC source voltage of 2 V–2.4 V, voltage generated is about 14.5 KV, discharge is 80 times per second and current consumption is about 480 mA. For comparison, the conventional ignitor heater 12 demanded current consumption on the order of 1100 mA.

(Switch Box 53)

The switch box 53 is snugly fitted in the shaft 45 with its lowest end seated on the fuel container 37. Details of the switch box 53 are discussed with reference to FIGS. 5 and 6.

Figure 5:
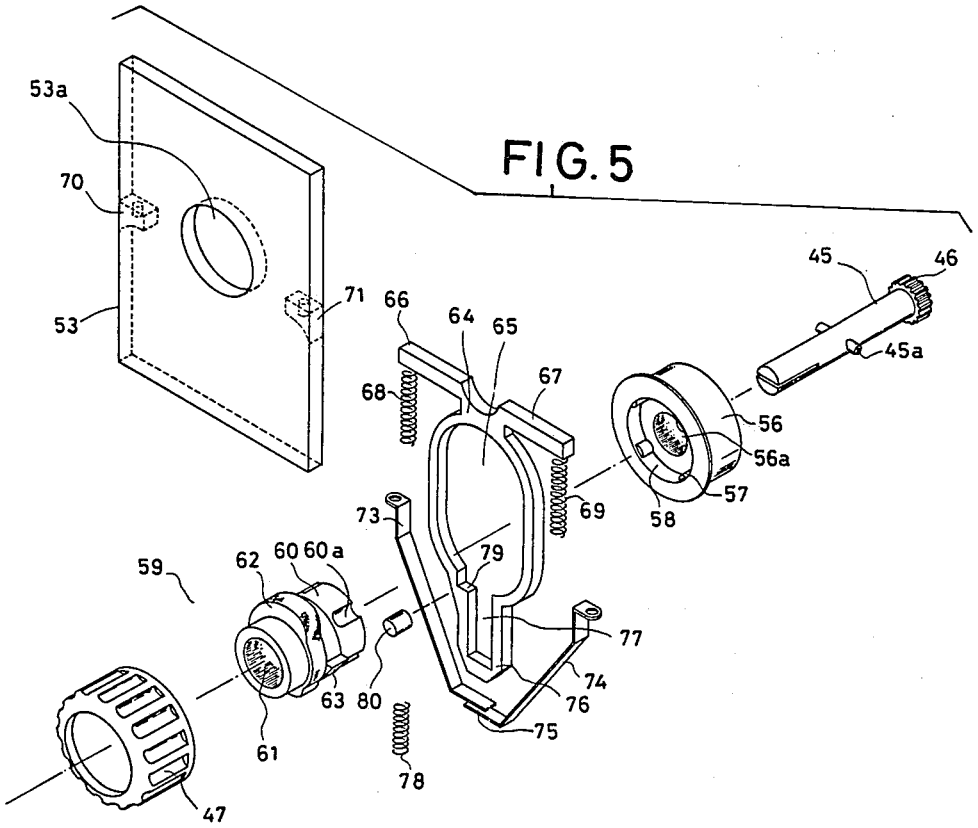
FIG. 5 is an exploded cross-sectional view of a switch in an ignitor assembly.

The wick adjust shaft 45 is rotatably held with respect to the fuel container 37, accommodating a cylindrical spring assembly 56 including a wick-lowering coil spring as illustrated in FIG. 5 therein via a hole 56*a*. The spring assembly 56 is therefore secured to be rotatable in union with the shaft 45 by means of a fixed pin 45*a*. Since a housing for the spring assembly is seated on the fuel container 37 and so on, revolution of the shaft 45 permits the spring and so on therein to rotate at the same time. A fitting tube 58 which constitutes part of the spring assembly and rotates with the shaft 45 is provided with projections 57 at its inner peripheral surface along its axial direction.

A tubular actuator 59 has at its one end a columnar projection 60 which is received within the fitting tube 58 of the spring assembly 45. Formed on the periphery of the projection 60 are grooves which receive the projections 57. The tubular actuator 59 has further at its central portion a hole 61 where the shaft 45 is inserted. Further provided on the periphery are a switch actuating cam 62 and an alignment arm 63. The shaft 45 is inserted via the spring assembly 56 into the hole 61. The wick adjust knob 47 is fixed on one end of the wick adjust shaft 45 extending from the tubular actuator 59 in a well known manner. The turning movement of the wick adjust knob 47 causes the raising and lowering of the wick 42 and the swinging of the tubular actuator 59. The wick is moved up and down in a conventional structure and a ratchet (not shown) prevents the shaft 45 from being rotated to the left and the wick 42 from being lowered from an elevated level.

Figure 6A:
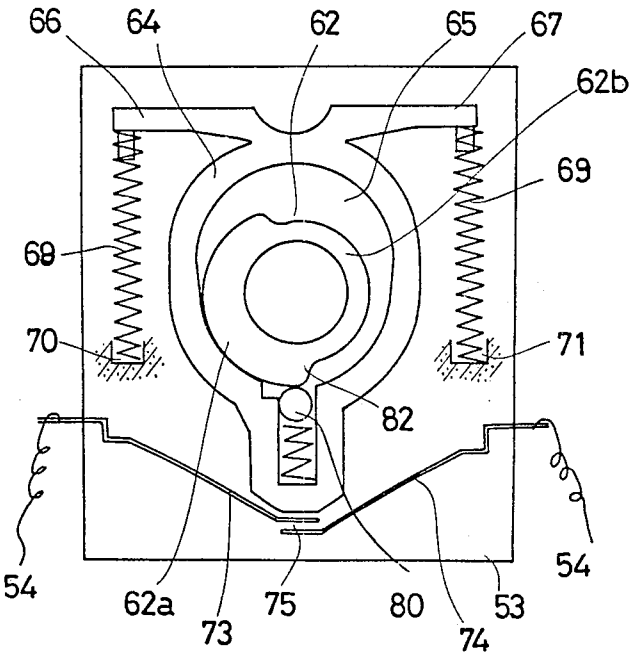
FIGS. 6(*a*), 6(*b*) and 6(*c*) are views for explanation of operation of the switch.
Figure 6B:
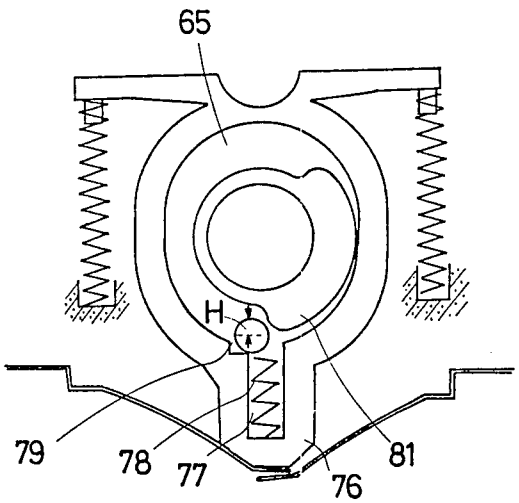
Figure 6C:
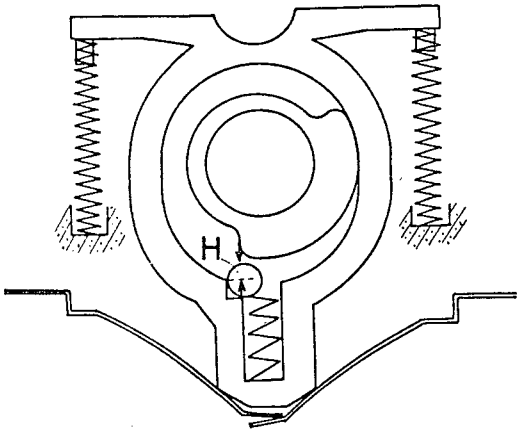

The switch box 53 is mounted in alignment with the cam 62 of the tubular actuator 59 rotating with the shaft 45 as a single unit, bearing a switch mechanism. An aperture 53*a* is perforated through front and back walls of the box 53. A movable blade 64 is held slidable in a vertical direction between the front and back walls of the box 53 and is provided with an oval slot 65 on which the periphery of the cam 62 slides. The cam 62 and the slide slot 65 are correlated as shown in FIGS. 6(*a*), 6(*b*) and 6(*c*). A greater diameter portion 62*a* (arc-shaped) of the cam 62 contacts in part the inner peripheral surface of the slide slot 65. The movable blade 64 has a pair of support arms 66 and 67 extending in a horizontal direction and being biased upwardly by coil springs 68 and 69 within the switch box. The springs 68 and 69 are held by fixtures 70 and 71. It is understood that the aperture 53*a* is long enough to extend across the cam 62 on the tubular actuator 59. Metallic contact plates 73 and 74 are housed in the switch box 53 with its one end secured on opposite side walls of the box 53 and connected to the lead wires 54 and the remaining end thereof piled at the central portion of the box 53, thus constituting a normally off switch 75. A switch actuator 76 is formed by a lower extension of the movable blade 64 in such a manner as to face against the switch 75 and bears a spring-receiving groove 77 which is open to the slide slot 65. The groove 77 receives a switch adjust spring 78. When being released, the upper end of the spring 78 is substantially flush with a flat portion of an L-shaped escape cutout 79 formed at the top of the left side wall, facing toward the groove 77. The force of the spring 78 is selected to be slightly weaker than that of coil springs 68 and 69. A columnar fail-safe pin 80 engages with the cutout 79 when the cam 62 makes a right turn and abuts on the right side wall of the groove 77 when the cam makes a left turn. The columnar pin 80 is of a length substantially equal to the thickness of the movable blade 64 and of such a diameter that its upper end extends upwardly from the upper extreme of the groove 77 by H when being fitted in the flat portion of the cutout 79 as seen from FIG. 6(*c*). The dimension of the pin 80 is however selected to be smaller than the length of the groove 77. The alignment arm 63 is to determine the relative position between the wick 42 and the cam 62.

(Ignition)

When the wick 42 is at the lowest level b, the respective components in the switch box 53 stand as shown in FIG. 6(*a*). In other words, the pin 80 is within the groove 77 while being urged by the left extreme of the greater diameter portion 62*a* of the cam 62. Because the force of the coil springs 68 and 69 are stronger than that of the spring 78, the movable blade 64 is hoisted such that the greater diameter portion 62*a* of the cam 62 comes into contact with the inner peripheral surface of the slide slot 65 under the influence of the springs 68 and 69. For this reason the lowest end of the actuator 76 of the movable blade 64 is kept apart from the switch 75 so that the switch 75 is still in the off position. In the illustrated embodiment, the greater diameter portion 62*a* of the cam 62 extends within the range of 110°, though it should not be limited thereto.

If the knob 47 is actuated naturally to make a right turn, then it normally swings by approximately 220° from a standpoint of human engineering. When this occurs, the upper end of the wick 42 moves up to the top of the inner and outer cylinders 39 and 36 or the level c of FIG. 3, while the cam 62 is at the level b as shown in FIG. 6(*b*). Accordingly, when the cam 68 is rotated to the right from the position as depicted in FIG. 6(*a*), a smaller diameter portion 62*b* of the cam 62 is in alignment with the pin 80 so that the pin 80 is urged upwardly so that its top contacts with the smaller diameter portion 62*b* by the force of the spring 78. However, the movable blade 64 is seated at a fixed level and the right extreme 81 of the greater diameter portion 62*a* of the cam 68 approaches the right side wall of the groove 77 while the switch is still off.

When the knob 47 is gripped again and turned to the right, the wick 42 is advanced in between the inner and outer shells 30 and 31. The right extreme 81 of the cam 62, on the other hand, abuts on a side wall of the fail-safe pin 80, forcing the pin 80 against the escape cutout 79 and stopping the pin 80 at this position (see FIG. 6(*c*)) upon the right turning movement of the cam. With the right extreme 81 of the cam 62 being somewhat rounded, further turning of the cam 62 to the right permits the outer peripheral surface of the greater diameter portion 62*a* of the cam 62 to slide along the periphery of the pin 80 and depresses the whole of the movable blade 64 by the height H of the pin 80 extending from the inner peripheral surface of the slide slot 65. This allows the actuator 76 of the movable blade 64 to switch on the path between the contact plates 73 and 74 as shown in FIG. 6(*c*), thus supplying the high voltage generator 51 with power. Under these circumstances, discharge starts taking place from the discharge pin 50 to the point a of the inner shell 30.

Thereafter, the greater diameter portion 62*a* of the cam 62 slides on the pin 80 and depresses the movable blade 64 to turn on the switch 75 and continue discharge until the upper end of the wick 42 reaches the highest level a. Since the knob 47 rotates by approximately 110° until the wick 42 moves from the level c to the level a, the cam 68 is turned right to a position far from the position as shown in FIG. 6(*c*) and the left extreme of the greater diameter portion 62*a* continues depressing the movable blade 64. Once the knob 47 has been turned 110° again and the wick 42 has reached its highest level, the wick moving mechanism prevents further revolution of the knob 47. Therefore, the switch 75 remains on to continue the discharge as long as force is applied to turn the knob 47 to the right. If the discharge lasts for 3 to 4 seconds, then the wick 42 is fired. When the knob 47 is free from the right turning force, the knob 47 and the shaft 45 are turned somewhat to the left and stopped at this position together with the knob 47 and so on due to the relationship between the ratchet and the return springs. As the shaft 45 makes such a slight left turn, the cam 62 also moves the same direction so that the pin 80 moves in the same direction out of the escape cutout 79 and abuts on the right side wall of the groove 77 and then plungs into the groove 77 due to the relative force of the springs 68, 69 and 78. As a result, the movable blade 64 moves up and the switch 75 is switched off.

Once the cam 62 has been turned to the left and the pin 80 has been received within the groove 77, the movement of the shaft 45 or the cam 68 permits merely the top of the pin 80 in the groove 77 to slide on the greater diameter portion 62*a* of the cam 68 whether it is turned to the right or left. In this mode of operation, the pin 80 neither returns to the cutout 79 nor is the switch 75 actuated to establish discharge.

The reason why the upper end of the wick 42 is ignited through discharge therethrough for 3–4 seconds is not clear. It is however believed that discharge repeats more times than with ignition of gas and a substantial amount of energy is generated during this period which vaporizes oil at the upper portion of the wick 42 and fires the vaporized oil. As the upper end of the wick 42 begins moving upwardly from the level c, discharge starts and travels across the upper portion of the wick with the upward movement of the wick. This shortens the time necessary for ignition. In the event that discharge starts before the wick 42 reaches the level a, the development of an upward flow of the surrounding air may help in shortening the time necessary for ignition together with other phenomena. Of course, it is possible to initiate discharge after the wick 42 is moved up to the level a. In this case, it takes a longer time to complete ignition.

In this manner, pursuant to the present invention discharge permits firing of the wick 42 within 3 to 4 seconds of the begining of discharge. As stated previously, the ignitor assembly embodying the present invention demands only 690 mA of current consumption, that is, two thirds of the prior art assembly. It is also possible to effect discharge firing even when the power voltage falls to 2 V or 2.4 V.

The following will set forth how to extinguish the oil stove. This is accomplished by either turning the knob 47 to the left or lowering the wick 42 to the level b through the use of an automated extinguisher. While the cam 62 is turned to the left and shifted from the position of FIG. 6(*b*) to that of FIG. 6(*a*), the pin 80 is brought into alignment with the smaller diameter portion 62*b* of the cam 62. However, the pin 80 moves up by only a slight amount and does not vary the position of the movable blade 64 nor does it actuate the switch 75. Even though the cam 62 is turned to the left and the left extreme 82 of the greater diameter portion 62*a* contacts the equivalent of the pin 80, the pin 80 is no longer turned to the right because of the top of the right side wall of the groove 77 being higher than the pin 80. Eventually, the pin 80 jumps into the groove 77 against the force of the spring 78 as seen from FIG. 6(*a*).

Re-ignition can be completed in the above discussed manner without the need to hoist the burner as experienced in the prior art.

The above-illustrated embodiment has the advantages of elongating the life of the ignitor assembly with a minimum of power consumption. Improper discharge is inhibited even when carbon or other foreign matters are deposited on the tip of the discharge pin 50. Even if this occurs, the carbon is wiped off each time the tip of the discharge pin 50 comes into contact with the upper end of the wick 42. Misalignment of the ignitor plug 49 with respect to the inner shell 30 has no or less adverse effect on discharge ignition. This eliminates the need for high accuracy of machining and minimizes the occurrence of inferior ignitor assemblies.

(Other Embodiments)

(1) The ignitor plug 49 is installed on the inner shell side 39 and discharge takes place toward the outer shell side 31.

(2) A plurality of the ignitor plugs are provided about the wick 42 and discharge takes place at a plurality of locations at the same time.

(3) Two discharge pins are provided in the circumferential direction or the axial direction and discharge takes place between these two pins.

(4) A switch is provided which controls power supply regardless of the movement of the wick 42. After the wick 42 has been hoised to the level a, that switch is manually switched on to fire the wick.

The invention being thus described, it will be obvious that the same may be varied in many ways. Such variations are not to be regarded as a departure from the spirit and scope of the invention, and all such modifications are intended to be included within the scope of the following claims.

What is claimed is:

1. An ignitor assembly for a liquid fuel stove having a housing including a shell burner in communication with liquid fuel disposed within said housing and a wick operatively positioned to be ignited for igniting the shell burner, said ignitor assembly comprising:

an ignitor plug operatively positioned to be in alignment with an exposed portion of said wick, said ignitor plus being secured to said housing to be fixed in a predetermined position;

voltage source means for supplying power being operatively connected to said ignitor plug for supplying power to create discharge sparks directed towards said wick;

adjustment means for imparting movement to said wick to establish alignment of said wick and said ignitor plug;

actuating means for selectively supplying power to said ignitor plug for igniting said ignitor plug to discharge sparks toward said wick for initially vaporizing liquid fuel and subsequently igniting the wick and the shell burner without imparting movement to said ignitor plug relative to said housing;

said adjustment means including a knob and a shaft rotatably mounted relative to said housing for raising and lowering said wick;

said actuating means being a switch operatively connected to said shaft for selectively being actuated and deactuated as said knob is manually rotated;

a switch housing;

a slide slot being biased to a first position within said switch housing; and a cam being operatively connected to said slide slot to impart movement to said slide slot to displace said slide slot from said first position to actuate said switch;

said cam and said knob being operatively connected together to rotate in unison, said cam imparting movement to said slide slot to selectively actuate and deactuate said switch.

2. An ignitor assembly according to claim 1, wherein said voltage source means is a DC voltage source.

3. An ignitor assembly according to claim 1, wherein said ignitor plug is positioned within a plug housing constructed of a ceramic material.

4. An ignitor assembly according to claim 1, wherein said knob is rotated approximately 330° before said switch is actuated.

5. An ignitor assembly according to claim 1, wherein initial rotation of said knob advances said wick to an operative position within said housing and continued rotation of said knob actuates said switch to supply power to said ignitor plug.

6. An ignitor assembly according to claim 1, and further including a return spring for returning said knob to an inoperative position after a manual force is released therefrom.

* * * * *